US010550496B2

(12) United States Patent
Ootsubo et al.

(10) Patent No.: US 10,550,496 B2
(45) Date of Patent: Feb. 4, 2020

(54) METHOD FOR PRODUCING YARNS SEPARATED FROM REINFORCING FIBER STRANDS

(71) Applicant: Teijin Limited, Osaka-Shi, Osaka (JP)

(72) Inventors: Makoto Ootsubo, Osaka (JP); Yukino Oosawa, Osaka (JP)

(73) Assignee: Teijin Limited, Osaka-Shi, Osaka (JP)

( * ) Notice: Subject to any disclaimer, the term of this patent is extended or adjusted under 35 U.S.C. 154(b) by 177 days.

(21) Appl. No.: 15/553,323

(22) PCT Filed: Feb. 24, 2016

(86) PCT No.: PCT/JP2016/055433

§ 371 (c)(1),
(2) Date: Aug. 24, 2017

(87) PCT Pub. No.: WO2016/136812

PCT Pub. Date: Sep. 1, 2016

(65) Prior Publication Data

US 2018/0119317 A1 May 3, 2018

(30) Foreign Application Priority Data

Feb. 26, 2015 (JP) ..... 2015-037164

(51) Int. Cl.
*D02J 1/18* (2006.01)
*B65H 51/005* (2006.01)
*D01D 11/02* (2006.01)

(52) U.S. Cl.
CPC ..... *D02J 1/18* (2013.01); *B65H 51/005* (2013.01); *D01D 11/02* (2013.01); *B65H 2701/31* (2013.01)

(58) Field of Classification Search
CPC ..... D01F 9/12; B29C 70/10; D04H 1/4242; D04H 3/002; D02J 1/18
See application file for complete search history.

(56) References Cited

U.S. PATENT DOCUMENTS 3,840,941 A * 10/1974 Neveu ..... B65H 51/005 28/220
5,101,542 A * 4/1992 Nakagawa ..... B65H 51/005 19/65 T
6,385,828 B1 5/2002 Kiss et al.
8,490,253 B2 * 7/2013 Junker ..... D02J 1/18 19/66 R
9,185,969 B2 * 11/2015 Takahashi ..... D02J 1/22
(Continued)

FOREIGN PATENT DOCUMENTS

EP 2687356 A1 1/2014
JP S57-77342 A 5/1982
(Continued)

OTHER PUBLICATIONS

Mar. 29, 2016—International Search Report—Intl App PCT/JP2016/055433.

(Continued)

*Primary Examiner* — Tajash D Patel
(74) *Attorney, Agent, or Firm* — Banner & Witcoff, Ltd.

(57) ABSTRACT

A method for producing yarns separated from reinforcing fiber strands including a process of intermittently separating fibers of the reinforcing fiber strands.

7 Claims, 2 Drawing Sheets

(56) References Cited

U.S. PATENT DOCUMENTS

| | | | |
|---|---|---|---|
| 2007/0026192 | A1 | 2/2007 | Yochida |
| 2011/0094358 | A1 | 4/2011 | Aramizu et al. |
| 2012/0213997 | A1 | 8/2012 | Wang et al. |

FOREIGN PATENT DOCUMENTS

| | | | |
|---|---|---|---|
| JP | H11-156852 | A | 6/1999 |
| JP | 3049225 | B2 | 3/2000 |
| JP | 2005-329720 | A | 12/2005 |
| JP | 2006-219780 | A | 8/2006 |
| JP | 2007-31919 | A | 2/2007 |
| JP | 2007-313697 | A | 12/2007 |
| JP | 2011-241494 | A | 12/2011 |
| WO | 2009/153833 | A1 | 12/2009 |
| WO | 2016104154 | A1 | 6/2016 |

OTHER PUBLICATIONS

Mar. 15, 2016—(PCT/JP) Written Opinion—App 2016/055433—English Translation.
Feb. 2, 2016—(JP) Office Action—App 2015/037164—w/Concise Explanation.
May 10, 2017—(PCT/JP) Third Party Observation—App 2016/055433.
Aug. 31, 2017—(JP) Opposition—App 2015-037164 (Pat No. 607757B)—w/Concise Explanation.
Masahiro Mogi, Toru Morri, Daisuke Higuchi, and Mitsutoshi Hirota, "Opening Technique and Possibility Thereof", 26 pages.

* cited by examiner

METHOD FOR PRODUCING YARNS SEPARATED FROM REINFORCING FIBER STRANDS

CROSS REFERENCE TO RELATED APPLICATIONS

This is a U.S. National Phase Application under 35 U.S.C. § 371 of International Application No. PCT/JP2016/055433, filed Feb. 24, 2016, which claims priority to Japanese Application No. 2015-037164, filed Feb. 26, 2015, the entire contents of each of which are incorporated herein by reference.

TECHNICAL FIELD

The present invention relates to a method for producing yarns separated from reinforcing fiber strands.

BACKGROUND ART

In recent years, there have been active study on achieving much more lightweight of a structure by using a fiber reinforced composite material in a structural material of a housing of an electronic device or an automobile. In production of the fiber reinforced composite material, a fiber having a sufficient length for a roller to convey in a process and having a form of a combination of multiple single filaments each having a thickness (diameter) of several μm, that is, form reinforcing fibers in strands form (reinforcing fiber strands), is appropriately processed and used as a reinforcing fiber in many cases.

In the related art, as a method of using the reinforcing fiber strands in the fiber reinforced composite material, a method, in which thick reinforcing fiber strands containing a large number of constituent single filaments is produced, the strands are widened or the like such that thin flat reinforcing fiber strands are made, and the thin flat strands are used directly or the thin flat strands are subjected to separating and then are used, have been known as a preferable method in terms of cost reduction.

As a method for widening the reinforcing fiber strands, a method for dispersing constituent fibers in a width direction by applying a water current or a high-pressure air current to the reinforcing fiber strands, a method for spreading strands by applying, to the strands in the air or in a liquid, vibration generated due to an ultrasonic wave or the like (PTL 1 or PTL 2), a method for extending and spreading strands through contact between the strands and a widening jig (for example, PTL 3), or the like has been known.

In addition, as a separating technology, a method for continuously separating reinforcing fiber strands by using a comb-like jig (PTL 4), a method for separating strands by actively cutting a single filament having a variation in a positional relationship in the reinforcing fiber strands in a length direction (PTL 5), or the like has been known. However, since it is possible to achieve more cost down due to the fiber reinforced composite material, there is a demand for a method for stable and mass production of yarns separated from the reinforcing fiber strands.

CITATION LIST

Patent Literature

[PTL 1] JP-A-S57(1982)-77342
[PTL 2] Japanese Patent No. 3049225

[PTL 3] JP-A-2007-313697
[PTL 4] U.S. Pat. No. 6,385,828
[PTL 5] JP-A-2006-219780

SUMMARY OF INVENTION

Technical Problem

The present inventors found that the methods for producing yarns separated from the reinforcing fiber strands in the related art have such specific problems described above and accomplished a method for producing fibers which solves the problems.

The reinforcing fiber strands have a slight twist in a process of producing the strands or has variations in a positional relationship between single filaments constituting the reinforcing fiber strands in a length direction in many cases, and the twist or the variations in length interferes with continuous separating of the strands.

In the method for separating fibers as disclosed in PTL 4, there are variations in the positional relationship between the single filaments in the reinforcing fiber strands in the length direction, and twists are gradually accumulated in a local portion in a comb due to presence of a single filament laying in an inclined manner in the strands. As a result, process tension remarkably increases, a large amount of lint is generated or the fibers are damaged, or, eventually, the reinforcing fiber strands are cut in some cases.

In a case where a widened reinforcing fiber strands are separated, the problems due to the twist or the variations in position of the single filament become serious.

In the method for separating fibers as disclosed in PTL 5, winding troubles due to cut single filaments often arise, a large amount of lint is generated, and blade wear remarkably occurs.

An object of the present invention is to provide a method for producing yarns separated from reinforcing fiber strands, which solves the problems in the related art and which is possible to continue an operation stably for a long time.

BRIEF DESCRIPTION OF DRAWINGS

A method for producing yarns separated from reinforcing fiber strands of the present invention includes a process of intermittently separating fibers of the reinforcing fiber strands.

In the method for producing the yarns separated from the reinforcing fiber strands of the present invention, preferably the process of intermittently separating fibers of the reinforcing fiber strands is performed by using a separating jig, and the separating jig is provided with a separating portion having a concave-convex shape and the following conditions of (1) and (2) are satisfied:

(1) A height of a convex portion is set to one or more times of a whole thickness of the strands; and (2) curvature radius R of a distal end of the convex portion set to 0.01 mm to 50 mm.

In addition, the present invention includes an invention of a separating jig including a separating portion having a concave-convex shape, wherein the following conditions of (1') and (2) are satisfied:

(1') a height of a convex portion is set in a range of 0.008 mm to 10,000 mm; and (2) curvature radius R of a distal end of the convex portion set to 0.01 mm to 50 mm.

The present invention provides a method for producing yarns separated from reinforcing fiber strands, which is possible to continue an operation stably for a long time. The present invention enables to efficiently gain yarns separated from reinforcing fiber strands, which have a desired width.

Figure 1:
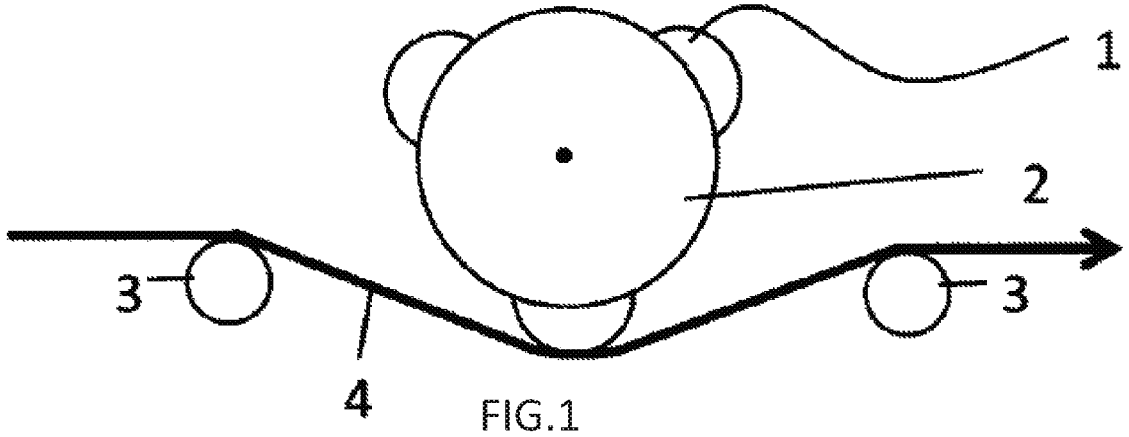

FIG. 1 is a schematic diagram of separating of reinforcing fiber strands by using a wheel type separating jig.

Figure 2:
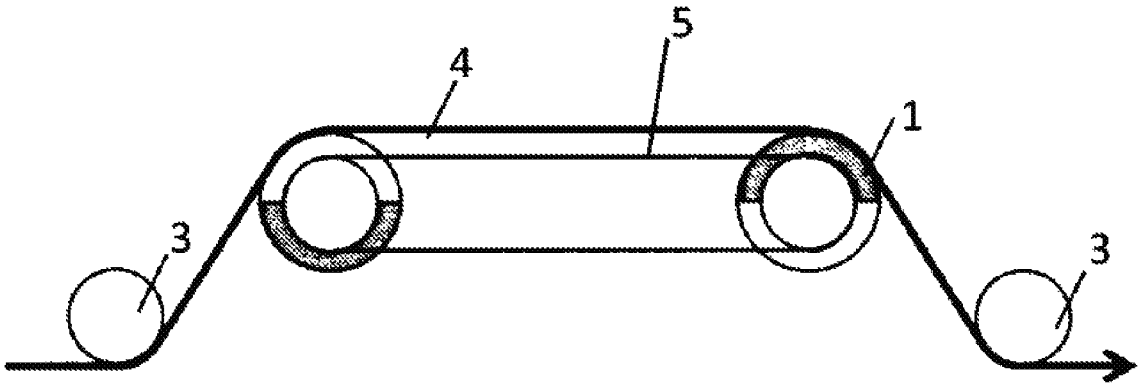

FIG. 2 is a schematic diagram of separating of the reinforcing fiber strands by using a phase difference type separating jig.

Figure 3:
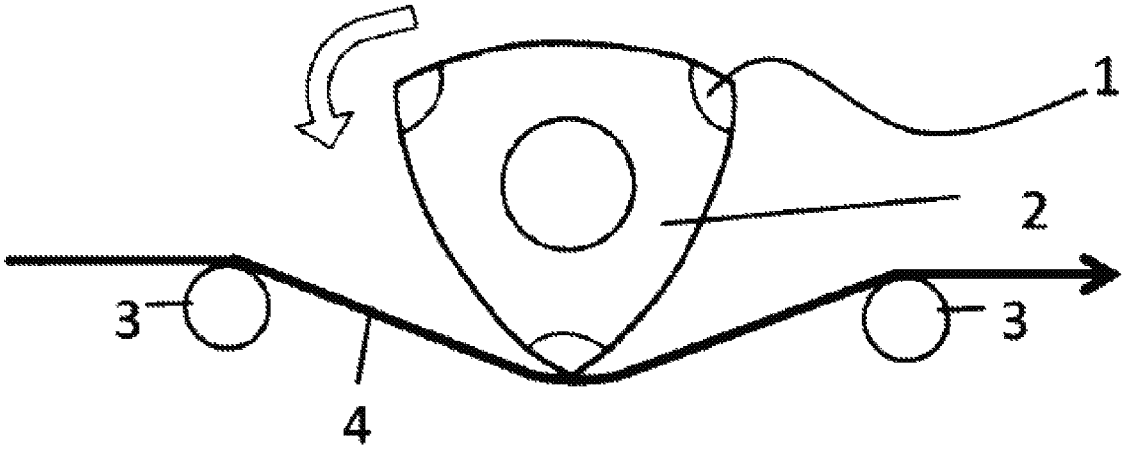

FIG. 3 is a schematic diagram of separating of the reinforcing fiber strands by using a wheel type separating jig (a Reuleaux triangular shape when viewed in an axial direction).

Figure 4:
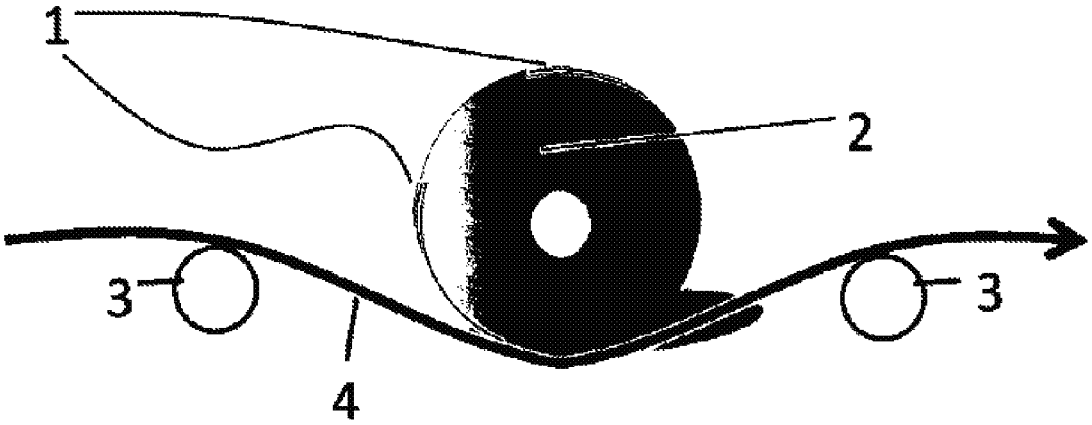

FIG. 4 is a schematic diagram of separating of the reinforcing fiber strands by using a wheel type separating jig (spherical shape).

Figure 5:
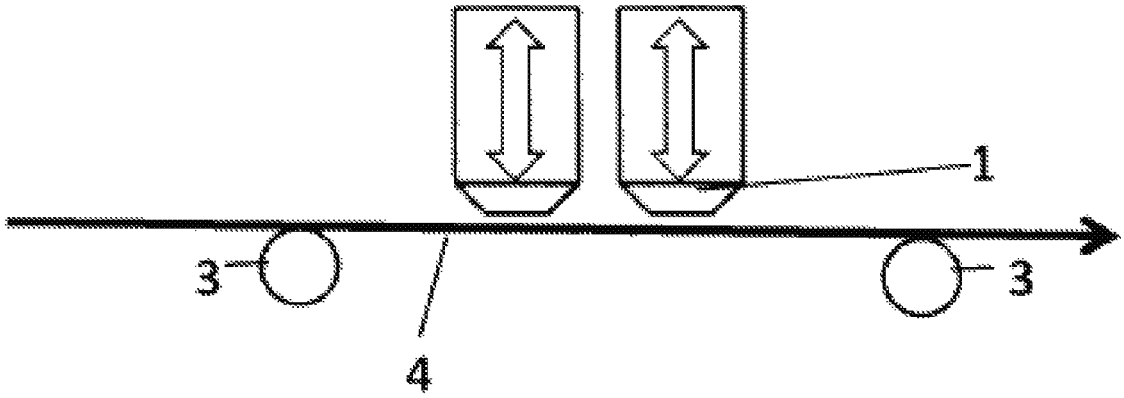

FIG. 5 is a schematic diagram of separating of the reinforcing fiber strands by using a push type separating jig.

DESCRIPTION OF EMBODIMENTS

According to the present invention, there is provided a method for producing yarns separated from the reinforcing fiber strands (hereinafter, simply abbreviated to separated yarns in some cases) including a process of intermittently separating the reinforcing fiber strands (hereinafter, simply abbreviated to strands in some cases).

Regarding a reinforcing fiber used in the present invention, there is no particular limitation on a type of fiber as long as the fiber is a high-strength fiber that can be used in a fiber reinforced composite material, and examples of the fiber can include at least one type selected from a group consisting of various types of inorganic fibers or organic synthetic fibers. More specifically, it is preferable that at least one type selected from a group consisting of a carbon fiber, a glass fiber, a boron fiber, a basalt fiber, and the like, is used as the inorganic fiber, and an aromatic polyamide fiber is used as the organic synthetic fiber. Of the fibers, the producing method of the present invention is particularly effective in the carbon fiber or the like. It is possible to use any carbon fiber of a polyacrylonitrile (PAN)-based carbon fiber, a petroleum pitch-based carbon fiber, a coal pitch-based carbon fiber, a rayon-based carbon fiber, a lignin-based carbon fiber, or the like, and, particularly, the PAN-based carbon fiber with PAN as a row material is good in productivity and mechanical properties in the industrial scale and, thus, is especially optimal.

According to the present invention, the process of intermittently separating fibers may be performed on a plurality of types of reinforcing fiber strands at the same time. Examples of the plurality of types of reinforcing fiber strands include a combination of carbon fiber strands and glass fiber strands, a combination of PAN-based carbon fiber strands and lignin-based carbon fiber strands, or a combination of regular tow of PAN-based carbon fiber strands and large tow of PAN-based carbon fiber strands.

The reinforcing fiber strands used in the present invention preferably have a bundle structure in which a plurality of single filaments are gathered, and more preferably a bundle structure in which the plurality of single filaments are aligned in the same direction without a twist. The number of single filaments constituting the bundle structure is preferably 1,000 to 100,000, because the effects of the present invention are particularly remarkable, and, more preferably in a range of 6,000 to 70,000. When the reinforcing fiber strands having the number of single filaments in the range described above are used, it is easy to exhibit the effects of the present invention.

Total fineness of the reinforcing fiber strands is preferably 30 tex to 500,000 tex, and particularly preferably 200 tex to 4,000 tex.

As the reinforcing fiber, a diameter of the single filament constituting the bundle structure is preferably in a range of 1 μm to 10 μm, and particularly preferably in a range of 5 μm to 10 μm. This is because high reinforcement effects on a matrix tend to be achieved when the reinforcing fiber containing the single filaments having the diameter is used as the fiber reinforced composite material.

In addition, tensile strength of the reinforcing fiber is preferably in a range of 600 MPa to 15 GPa, and particularly preferably in a range of 1,000 MPa to 10,000 MPa.

A whole width of the reinforcing fiber strands before the separating is preferably in a range of 1 mm to 300 mm in that it is easy to obtain such strands, more preferably in a range of 3 mm to 300 mm, still more preferably 5 to 100 mm, and particularly preferably in a range of 8 mm to 40 mm. According to the present invention, there is no particular limitation on the number of strands when the reinforcing fiber strands are used, and the strands may be processed one by one, or the plurality of strands may be gathered and processed at once. In a case where such plurality of strands are used, a method of supplying multiple spindles is also preferable. Jigs extend in the axial direction depending on the number or the width of input strands, and thereby it is possible to easily cope with any situations in the producing method of the present invention.

The reinforcing fiber strands used in the present invention preferable have a slightly flat shape, and there is no particular limitation on the shape; however, the strands preferably have a rectangular, circular, or elliptic whole cross section. A whole thickness of the strands is preferably in a range of 0.01 to 10 mm, more preferably in a range of 0.05 to 3 mm, still more preferably in a range of 0.05 to 1 mm, and most preferably in a range of 0.08 to 0.5 mm. The thickness may be set in a combination of the lower limit value in one range and the upper limit value of the other range of the ranges above. For example, when the carbon fiber is used, it is possible to measure the thickness by using a caliper or a micrometer, and the unwidened strands are made into a bundle with a sizing agent in many cases. In addition, when any reinforcing fiber is used, it is possible to polish a cross section in a resin, to observe the cross section with a microscope or the like, and to measure a thickness with accuracy.

Normally, it is preferable that the sizing agent is attached to the reinforcing fiber strands used in the present invention in advance. An attachment amount of the sizing agent is preferably 0.01 to 15 parts by mass with respect to 100 parts by mass of the reinforcing fiber, and particularly preferably 0.01 to 5 parts by mass. There is no particular limitation on a type of sizing agent, and, for example, it is possible to use various types of compounds containing a functional group such as an epoxy group, a urethane group, an amino group, an amide group, an ether group, or a carboxyl group. In a case where the yarns separated from the reinforcing fiber strands obtained according to the present invention is reinforced with a matrix resin and is used as the fiber reinforced composite material, it is preferable that a resin-based sizing agent, in which the same resin as the matrix resin is used, is attached to the reinforcing fiber strands. For example, it is preferable that a polyamide resin-based sizing agent is used when the matrix resin is a polyamide resin.

A method for producing yarns separated from the reinforcing fiber strands of the present invention includes a process of intermittently separating fibers of such reinforcing fiber strands. The process of the intermittent separation is preferably performed by using a separating jig. Normally, the reinforcing fiber strands have a slight twist during manufacturing the strands or have variations in a positional relationship between single filaments in a length direction. A defect due to the twist or the positional variations tends to increase through the widening.

Therefore, in a case where the reinforcing fiber strands are continuously subjected to the separating by the separating jig, the strands are gradually biased on the separating jig due to presence of a small number single filaments laying in an inclined direction in the strands, and thus a phenomenon in which it is not possible to perform uniform and stable separating occurs. However, since the present invention includes the process of the intermittent separation of the strands, a fiber path of the strands is rapidly restored to a normal path, and thus uniform and stable separating is performed even when the strands are biased.

In the producing method of the present invention, the process of the intermittent separation is performed by using the separating jig. The separating jig includes a separating portion having a concave-convex shape, a height of the convex portion is 0.8 times the whole thickness of the strands, and preferably 0.9 times, and curvature radius R of a distal end of the convex portion is preferably 0.01 mm (10 μm) to 50 mm.

In the producing method of the present invention, it is preferable that the separating portion having the concave-convex shape provided in the separating jig is formed to satisfy the following conditions of (1) and (2).

(1) A height of a convex portion is set to one or more times the whole thickness of the strands.

(2) The curvature radius R of the distal end of the convex portion is set to 0.01 mm (10 μm) to 50 mm.

The separating portion is provided with concavity and convexity arranged in a right-angle direction (width direction) of a traveling direction of the strands such that unevenness in fiber density in the strands occurs, thereby separating fibers of the strands. The separating portion having the concave-convex shape of the separating jig not only separates the fibers of the reinforcing fiber strands, but also has an effect of reducing variations in the width of the strands or an effect of securing a constant fiber path of the strands.

In the concave-convex shape of the separating portions of the separating jig used in the present invention, as a shape of the concavity and convexity arranged in the right-angle direction (width direction) of the traveling direction of the strands such that unevenness in fiber density in the strands occurs, specific examples of the shape are as follows. The shape may be a substantially discontinuous screw thread shape, a plurality of convex portions having a dorsal fin shape are disposed to have a longitudinal direction thereof facing the traveling direction of the strands and to be parallel to each other in the width direction of the strands toward the traveling direction of the strands, and thereby the concave portions are formed therebetween. Here, the substantial screw thread shape means a shape formed by the concavity and convexity arranged to be parallel to each other, like the screw thread; however, it is not particularly necessary for the convex portion to have a spiral shape in the axial direction like a real screw.

Regarding the separating jig according to the present invention, it is preferable that a plurality of concave-convex shapes, which are formed by a plurality of convex portions having the dorsal fin shape and the concave portions formed between the convex portions, are formed partially on an outer periphery when viewed from a rotation axis of the separating jig, and thereby it is easy to intermittently separate the fibers of the reinforcing fiber strands, in a case where a rotary type separating jig is used.

As the separating jig used in the present invention, it is preferable that the curvature radius R of the distal end of the convex portion of the separating portion satisfies the condition of (2) above, because the separating is very smoothly performed and it is easy to make or procure the separating jig. The lower limit of a range of the curvature radius R is preferably 0.025 mm (25 μm), and more preferably 0.05 mm (50 μm). The upper limit of the range of the curvature radius R is preferably 10 mm, and more preferably 1 mm. The range of the curvature radius R may be set by a combination of values appropriately selected from the preferable upper limit value and lower limit value, respectively, as an example, the range is preferably 0.025 mm (25 μm) to 10 mm, and more preferably 0.05 mm (50 μm) to 1 mm.

In a case where the separating jig includes a portion having the concave-convex shape, a difference in height of the concavity and the convexity, that is, the height of the convex portion is preferably one or more times the whole thickness of the strands, more preferably five or more times, and still more preferably ten or more times. The height of the convex portion is preferably 1,000 or less times the whole thickness of the strands, more preferably 100 or less time, still more preferably 60 or less times, and most preferably 30 or less times. In a case where the concavity and the convexity is larger than the whole thickness of the strands, it is possible to reliably perform the separation. The height of the convex portion of the separating portion of the separating jig may be the same in the entire convex portions, or may not be the same therein.

The separating jig used in the present invention may have a shape of a roll or a pin, a surface, which comes into contact with the strands, may have a comb shape, thin plate-shaped convex portions may overlap each other at a certain interval such that the plate-shaped convex portions intermittently separate fibers of the strands. It is preferable that the separating jig has concavity and convexity in the surface which comes into contact with the strands, or has a pin shape including a surface, which comes into contact with the strands, has concavity and convexity. In a case where the separating jig has a cylindrical shape such as a roll or a pin, a diameter thereof is preferably 5 to 900 mm, and more preferably 10 to 500 mm.

It is also preferable that, as the separating jig used in the producing method of the present invention, one separating jig includes a plurality of separating portions. In this case, the plurality of separating portions of the one separating jig come into contact with the reinforcing fiber strands at the same time, and thereby the reinforcing fiber strands have a region that is brought into contact with a non-separating portion between the separating portions of the separating jig such that the process of intermittently separating the reinforcing fiber strands is performed. In this case, it is necessary for the reinforcing fiber strands to come into sufficient contact with the separating jig. Otherwise, the separating jig is caused to rotate at the same speed as that of the traveling strands, the separating jig vertically moves, or the like. In this manner, it is possible to generate separating portions and non-separating portions.

More specifically, in a case where a rotary body such as one roll is used as the separating jig, it is preferable that a plurality or concave-convex portions, which extend in a circumferential direction of the rotary body such as one roll, are provided, and the concave-convex portions are disposed as the separating portions. The traveling strands are sufficiently wound around the roll or the like, or the roll or the like is caused to rotate, and thereby the strands are intermittently processed through the concave-convex portions (separating portions).

According to the present invention, it is also preferable that a process, in which the separating jig comes into contact with the strands on the fiber path of the strands a plurality of times, is performed as the process of intermittently separating the fibers of the strands, because it is easy to set process flow. For example, it is preferable that a plurality of rollers having the separating portion are disposed and come into contact with the fiber strands, because it is easy to procure or install the jig or a device. In addition, it is preferable that one or a plurality of rolls, which are provided with a plurality of separating portions and non-separating portions alternately in a circumferential direction of the one roll, are disposed as the roll. Particularly in this case, since the separating portions and the non-separating portions are disposed on the single roll, it is possible to frequently repeat the contact and non-contact of the separating portion with the strands.

It is preferable that the separating jig used according to the present invention, has the separating portion having such concave-convex shape described above, and the rotary body such as a roll, of which the convex portion having the concave-convex shape satisfies the conditions of (1) and (2) described above, is provided. In other words, the present invention includes invention of a separating jig that includes a separating portion having the concave-convex shape and satisfies the following conditions of (1') and (2).

(1') A height of the convex portion is set in a range of 0.008 mm to 10,000 mm (2) Curvature radius R of the distal end of the convex portion is set to 0.01 mm (10 μm) to 50 mm.

It is preferable that the separating jig of the present invention has the separating portions, the concave-convex shape of the separating portions has a substantially discontinuous screw thread shape, or a plurality of convex portions having the dorsal fin shape are disposed to have the longitudinal direction thereof facing a direction and are disposed to be parallel to each other substantially in a horizontally perpendicular direction to the direction, and thereby the concave portions are formed therebetween. Here, the substantial screw thread shape means a shape formed by the concavity and convexity arranged side by side as screw thread; however, it is not particularly necessary for the convex portion to have a spiral shape in the axial direction like a real screw.

Regarding the separating jig according to the present invention, it is preferable that a plurality of the concave-convex shapes, which are formed by a plurality of convex portions having the dorsal fin shape and the concave portions formed between the convex portions, are formed partially on the outer periphery when viewed from the rotation axis of the separating jig, and thereby it is easy to intermittently separate the fibers of the reinforcing fiber strands, in a case where a rotary type separating jig is used.

The height of the convex portion of the separating jig of the present invention is preferably 0.05 mm or larger, more preferably 0.5 mm or larger, and still more preferably 1.0 mm. The height of the convex portion is preferably 1,000 mm or smaller, more preferably 100 mm or smaller, still more preferably 10 mm, and particularly preferably 5 mm.

It is preferable that the separating jig of the present invention is a rotation type separating jig that performs the separating by a rotary body, such as a wheel type separating jig or a phase difference type separating device, or, particularly, it is preferable that the rotary body rotates in a direction in which the strands are separated into separated yarns and the yarns are transmitted.

For example, it is particularly preferable that the wheel type separating jig, a push type separating jig, or the phase difference type separating device is used as the separating jig used in the present invention, or the separating device including the separating jig. In the accompanying figures in this application related to the separating device, for simplification, the separating jig is illustrated when viewed in a horizontally perpendicular direction with respect to the traveling direction of the strands, and thus, for example, the thickness in the horizontally perpendicular direction, that is, in a rotary axis direction is not shown, in a case of the wheel type separating jig. There is no particular limitation on the thickness of the separating jig in the horizontally perpendicular direction, and the thickness may be set depending on the width or the number of the reinforcing fiber strands which are separated into fibers. In other words, the separating jig used in the present invention may have a so-called disc shape having a small thickness, or a cylindrical shape elongated in the horizontally perpendicular direction.

For example, as illustrated in FIG. 1, the wheel type separating jig includes a relatively small separating portion installed at several locations on a wheel (disk) having a large diameter. As illustrated in an example in FIG. 3, the wheel type separating jig may have a Reuleaux triangular shape as a shape viewed in the horizontally perpendicular direction, that is, the rotation axis direction, with respect to the traveling direction of the strands. The wheel type separating jig may be a separating jig having a spherical shape as illustrated in the example in FIG. 4.

An example of the push type separating jig includes the jig illustrated in FIG. 5.

It is preferable that a material of the separating portion of the separating jig used in the present invention is cemented carbide. It is preferable that the separating portions may be disposed and fixed on the circular circumference at equal intervals. It is preferable that the separating portion has the concavity and convexity present to have a shape obtained when a cylinder is divided into two parts in a longitudinal direction thereof.

More specifically, the diameter of the wheel of the wheel type separating jig is preferably in a range of 30 to 1,500 mm. There is no particular limitation on a winding angle of the strands around the wheel type separating jig, and the winding angle is preferably in a range of 10 to 270 degrees. The roll for converting the fiber path is disposed in front of and in back of the separating jig, and thereby the winding angle can be any angle smaller than 360 degrees in the range described above. The number of separating portions is preferably two or more, particularly, in a range of three to ten.

In addition, the separating may be intermittently performed, and the wheel may rotate in the same direction as or in an opposite direction to the traveling direction of the strands, and preferably the same direction from a surface for reduction in lint generation. Here, in a case where it is necessary to avoid generating the non-separating portion particularly in a case where the wheel rotates in the same direction, it is necessary to cause the wheel to rotate at a speed higher than a traveling speed of the strands. It is possible to apply a wide range of a peripheral speed depending on the traveling speed of the strands; however, it is preferable that the peripheral speed is normally 1,000 m/min or lower, particularly in a range of 5 to 300 m/min. In addition, tension is important for the separating, and thus the tension of fiber strands subjected to the separating is preferably 10 kgf (98 N) or lower, particularly in a range of 0.1 to 5 kgf (0.98 to 49 N). When the tension is too low, the strands tend to sag, a separating defect tends to be generated, and an adverse effect is affected on tension fluctuation when intermittent contact is performed. Conversely, when the tension is too high, the strands tend to be damaged.

According to the present invention, the phase difference type separating device is configured to include two or more separating jigs, and is a device that intermittently separates fibers of the strands when the separating portions of the separating jig alternately come into contact with the strands while a relationship, in which one separating portion of the separating jig is in contact with the strands when the other separating portion of the separating jig is not in contact with the strands, is maintained. As an example of the phase difference type separating device, FIG. 2 illustrates a device having a structure in which a plurality of separating rolls (separating jig including a separating portion having the concave-convex shape) are disposed to be parallel to each other and have a part of a cylinder as the concavity and convexity (separating portion), the fiber strands are in contact with a part of the separating portion of one separating roll due to a phase difference, and the strands are in contact with a smooth surface (non-separating portion) on the opposite side of the separating portion of the other separating roll. The number of the separating rolls is preferably two or more.

More specifically, diameters of the separating rolls are preferably in a range of 10 to 1,000 mm, particularly, in a range of 500 mm or smaller. In addition, there is no particular limitation on a winding angle of the strands around the separating jig of the phase difference type separating device; however it is necessary for the strands to be sufficiently bitten by the concave-convex portion. The roll for converting the fiber path is disposed in front of and in back of a unit, and thereby the winding angle can be adjusted. In addition, the separating may be intermittently performed, and a method in which a location that comes into cyclic contact with the strands is changed may be employed, other than a method in which the separating roll rotates all the time. However, it is preferable that the same surface of the separating roll is not in contact with the strands for too long a time, and it is possible to apply a wide range of rotation depending on the traveling speed of the strands; however, it is preferable that the rotation is performed about once every three seconds. The rotation direction may be the same direction as or the opposite direction to the traveling direction of the strands, and preferably the same direction from the surface for reduction in lint generation. The tension of the strands subjected to the separating is preferably 10 kgf (98 N) or lower, particularly in a range of 0.1 to 5 kgf (0.98 to 49 N). When the tension is too low, the strands tend to sag, a separating defect tends to be generated, and an adverse effect is affected on tension fluctuation when intermittent contact with the separating portion is performed. Conversely, when the tension is too high, the strands tend to be damaged.

A material of the separating portion, which is used in the separating jig, such as the wheel type separating jig or the phase difference type separating jig is preferably cemented carbide, diamond, or the like. In addition, an effective width of the fiber path is sufficient as long as the width is larger than a whole width of the processed strands; however, in a case where the plurality of strands are processed at the same time, it is necessary to have a width depending on a total width thereof. In a case where the separating jig having the normal concave-convex shape is simply used, it is difficult to adjust process flow conditions such as tension, and it is much more difficult to perform the adjustment in a case where the whole width of the strands is wide. However, since intermittent contact or separation is performed in the producing method of the present invention, the separating is performed in optimal conditions every time. It is possible to select any interval as a concave-convex pitch, depending on a separated fiber as a target, and the interval is preferably 0.3 to 10 mm, or R at the apex of the convex portion or R of the concave portion is preferably 0.05 to 50 mm. Although small R of the apex to the convex portion results in high separating property, the small R tends to increase damage to the strands. In addition, it is possible for the shape of the separating portion to have various cross section shapes of a circle, an ellipse, a quadrangle, a trapezoid, a triangle, or the like, and it is preferable that R of the apex or a bottom portion is appropriately adjusted. There is no particular limitation on an angle of the side surface of one convex portion, the angle is preferably in a range of 15° to 90°, and optimally in a range of 30° to 90°.

In the producing method of the present invention, it is preferable that the widening is performed by a widening jig before or after the process of intermittently separating the fibers of the reinforcing fiber strands. There is no particular limitation on the widening jig, as long as the jig is capable of widening the strands; however, it is preferable that, in general, a jig having one gentle convex portion, as a so-called drum-shaped jig is used as the widening jig. According to the present invention, the fiber strands, which is widened in advance, is used, and thereby effects of stable production of the separated yarn are further exhibited.

The widening jig may have a shape of a roll or a pin, or the convex portion may be formed on a surface of the fixed jig, which comes into contact with a fiber bundle (strand). In a case where the separating jig has a cylindrical shape such as the roll or the pin, a diameter of the largest portion is preferably 5 to 900 mm, and more preferably 10 to 90 mm.

There is no particular limitation on a shape of a cross section of the widening jig as long as the convex portion is provided on the fiber path; however, the shape of the cross section of the jig is preferably a circular shape in that high flexibility in the winding angle or the fiber path is achieved in the circular shape. The winding angle is preferably 1° to 350°. It is possible to easily adjust the winding angle by changing a distance between jigs or a height of the jig.

It is preferable that the convex portion of the widening jig has a diameter larger than that of the center of the jig, and is processed to have a so-called Taiko (Japanese drum) shape. The convex portion has preferably a circular arc shape. In this case, the curvature radius R is preferably R=10 mm to 900 mm, and more preferably R=10 mm to 500 mm. When the curvature radius of the widening jig is too small, a widening state is likely to be defective. When the curvature radius is too large, insufficient widening tends to be performed.

Setting of an effective width of the widening jig enables the width of the reinforcing fiber strands obtained after the widening to be adjusted. Further, a use of a jig such as a flat bar, a pin, or a roll, which has the defined effective width, enables a widened object of the reinforcing fiber strands (separated yarns) having stable quality.

There is no particular limitation on a material of the widening jig which can be used in the present invention, the material is preferably metal such as stainless steel, iron, or copper, glass or ceramics such as alumina, or zirconia. It is also possible to perform a satin finish or polishing on the metal, surface finishing such as chrome plating, or coating the ceramics with a synthetic resin such as fluororesin. Most preferably, a hard chrome plating process is performed on the stainless steel. It is particularly preferable that a fiber having high rigidity, especially such as a carbon fiber, is used, because wear resistance of the jig from scratching improves. Further, it is possible to appropriately use the jig by applying vibration such as ultrasonic vibration, heating-.cooling to the widening jig in some cases.

According to the producing method of the present invention, it is preferable that the strands are subjected to a process by a converging jig in advance before the strands are subjected to the process by such a separating jig. There is no particular limitation on the converging jig, as long as the jig is capable of positioning the fiber path of the strands; however, it is preferable that, in general, a jig having one concave portion is used as the converging jig. The converging jig is a so-called Tsuzumi (Japanese hand drum) shaped jig.

The converging jig may have a shape of the roll or the pin, or concave portion may be formed in a surface of the fixed jig, which comes into contact with the strands. In a case where the converging jig has a cylindrical shape such as the roll or the pin, a diameter of the largest portion is preferably 5 to 900 mm, and more preferably 10 to 300 mm.

There is no particular limitation on a shape of a cross section of the converging jig as long as the concave portion is provided on the fiber path; however, the shape of the cross section of the converging jig is preferably a circular shape in that high flexibility in the winding angle or the fiber path is achieved in the circular shape. The winding angle is preferably in a range of 1° to 350°. It is possible to easily adjust the winding angle by changing a distance between jigs or a height of the jig.

It is preferable that the concave portion of the converging jig has a diameter smaller than that of the center of the jig, and is processed to have a so-called drum shape. The concave portion has preferably a circular arc shape. In this case, the curvature radius R is preferably R=10 mm to 900 mm, and more preferably R=10 mm to 500 mm. When R is too small, the reinforcing fiber is too much converged. Conversely, when R is too large, positioning effects tend to be degraded.

There is no particular limitation on a material of the converging jig which can be used in the present invention, the material is preferably metal such as stainless steel, iron, or copper, glass or alumina, or ceramics such as zirconia. It is also possible to perform a satin finish or polishing on the metal, surface finishing such as chrome plating, or coating the ceramics with a synthetic resin such as fluororesin. Most preferably, a hard chrome plating process is performed on the stainless steel. In particular, it is particularly preferable that a reinforcing fiber having high rigidity such as a carbon fiber is used, because wear resistance of the jig from scratching improves. Further, it is possible to appropriately use the jig by applying vibration such as ultrasonic vibration, heating.cooling to the converging jig in some cases.

In the producing method of the present invention, it is particularly preferable that processes are performed and widened by the converging jig, a jagged jig, and the widening jig in this order before the strands are subjected to a process by the separating jig, and it is preferable that the separating jig separates the fibers at the end. Here, the converging jig or the widening jig is the jigs as described above, and the jagged jig is a jig provided with small concavity and convexity so as to ensure the stable fiber path.

Further, it is possible to appropriately use the jig by applying vibration such as ultrasonic vibration, heating.cooling to the jig in some cases.

The converging jig, the jagged jig, and the widening jig which can be used in the producing method of the present invention, it is preferable that heating is performed by a heater or the like such that the reinforcing fiber strands are caused to be flexible and is easily processed. For example, it is preferable that the jigs are heated by a rod heater, or the like, and the jigs are used in the producing method of the present invention, in a state in which temperature is adjusted to about 30° C. to 300° C. as softening temperature of a common sizing agent.

It is possible to suitably use the yarns separated from the reinforcing fiber strands obtained in the producing method of the present invention, as the fiber reinforced composite material.

In the fiber reinforced composite material, it is preferable that the yarns separated from the reinforcing fiber strands of the present invention are contained as one or more types selected from a group consisting of a plurality of fibers aligned to be parallel to each other in one direction, rebundled strands of a plurality of fibers, various formed fabric or processed fabric of woven fabric, knitted fabric, nonwoven fabric, mat material, chopped strands, milled fiber, or the like.

In the fiber reinforced composite material, it is preferable that at least one is selected as a matrix component from a group consisting of metal, an inorganic compound such as ceramics, rubber, thermoplastic elastomer, thermosetting resin, thermoplastic resin, or the like.

EXAMPLE

Hereinafter, the present invention will be more described in detail on the bases of Examples.

Example 1

The following reinforcing fiber strands were continuously drawn out from a yarn feeding body in a condition of a line speed of 20 m/min, was processed by the converging jig, the jagged jig, and the convex jig in this order, the reinforcing fiber strands having a width of 20 mm were again processed by the wheel type separating jig, and the yarns separated from the reinforcing fiber strands (having an average thickness of 0.08 mm) were obtained. Average tension of the separated yarns obtained immediately after the separating process was 1.5 kgf (14.7 N) and the reinforcing fiber strands were uniformly subjected to the separating. A two-hour continuous operation was performed without stop, and no change in the width of the separated yarns was found even after time elapsed. The jigs or the other conditions are as follows.

<Reinforcing Fiber Strands>

0.5% by weight of polyamide resin-based sizing agent is attached to a PAN-based carbon fiber (having an average single filament diameter of 7 μm, 24,000 single filaments, fineness 1600 tex, and tensile strength of 4,000 MPa) to obtain strands bundled in a flat state with a width of 10 mm and a thickness of 0.15 mm, and the strands were used as the reinforcing fiber strands.

(Converging Jig)

The converging jig was made of stainless steel subjected to the hard chrome plating process, had a diameter ϕ of 90 mm at the largest portion, an effective width of 40 mm on the fiber path, one concave portion present in the fiber path, and the curvature radius R of 100 mm in the concave portion.

(Jagged Jig)

The jagged jig was made of stainless steel, and had a diameter of 90 mm, an effective width of 40 mm on the fiber path, many concavities and convexities formed in the fiber path, an angle θ of 80° on a side surface of the convex portion, a radius R of 0.05 mm at the apex of the convex portion, a radius R of 0.2 mm at the bottom of the concave portion, intervals of 1 mm between the apexes of the convex portion, and a height of 0.6 mm of the convex portion.

(Convex Jig)

The convex jig was made of stainless steel, had a diameter ϕ of 90 mm, an effective width of 20 mm on the fiber path, one convex portion present in the fiber path, and curvature radius R of 100 mm in the convex portion. In this Example, the reinforcing fiber strands were adjusted to have a whole width of the strands as the effective width of the fiber path by the convex jig, and were subjected to the intermittent separating process by the separating jig.

(Wheel Type Separating Jig)

As illustrated in FIG. 1, the wheel type separating jig is provided between two wheels (disks) having a diameter of 140 mm and includes the separating portions provided with concavity and convexity at three positions, which are disposed on and fixed to the circumference of the wheel at equal intervals. The separating portion was made of cemented carbide and had an effective width of 60 mm on the fiber path. The separating portion had a shape obtained when a cylinder having a height of 60 mm was divided into two parts in a longitudinal direction thereof, and had a concave-convex pitch of 1 mm as intervals on the separating portion, a concave-convex height (height of the convex portion) of 2 mm, R of 0.1 mm at the apex of the convex portion, and R of 0.3 mm in the concave portion.

(Another Condition)

Average tension was 0.7 kgf (6.86 N, measured a load cell type digital tension meter) immediately in front of the converging jig.

The converging jig, the jagged jig, and the widening jig were pins (cylindrical shape), and the rod heater (ϕ12 mm) was inserted from a side surface such that the jigs had a temperature of 120° C. (measured by a contact type thermometer).

The central portion of the jigs was linearly disposed, an intercentral distance of the pins was 200 mm, and a winding angle of the strands around the pins was about 50°. Then, the widened reinforcing fiber strands (widened object of strands) having a width of 16 mm were obtained.

The wheel type separating jig was caused to rotate at 140 rpm in the same direction as the strands traveling direction, and a process, in which the separating portions at three locations came into contact with and were separated from the widened object of strands in order, was performed. At this time, the winding angle of the widened object of strands around the wheel type separating jig, to which the separating portions were fixed, was 120°.

Example 2

An operation in Example 2 is the same as that in Example 1 except that the following phase difference type separating device was used instead of the wheel type separating jig, and the yarns separated from the reinforcing fiber strands (having an average thickness of 0.08 mm) were obtained. Average tension of the separated yarns obtained immediately after the separating process was 1.8 kgf (17.7 N) and the reinforcing fiber strands were uniformly subjected to the separating. A two-hour continuous operation was performed without stop, and no change in the width of the separated yarns was found even after time elapsed. The phase difference type separating device or the other conditions are as follows.

(Phase Difference Type Separating Device)

As illustrated in FIG. 2, the phase difference type separating device, that includes the separating portion having the concave-convex shape in a half of the cylinder, and two separating rolls (separating jigs) which have a diameter of 30 mm which are disposed to be parallel to each other, is used. In the phase difference type separating device, two separating rolls come into contact with the strands, the strands are in contact with the separating portion of one separating roll due to a phase difference, and the strands are in contact with a smooth region (non-separating portion) on the opposite side of the separating portion of the other separating roll. In this manner, the intermittent separating process is performed.

The separating portion of the separating roll was made of cemented carbide, and had an effective width of 60 mm on the fiber path, was positioned in a half of the separating roll (semicircular region), a concave-convex pitch of 1 mm as intervals, a concave-convex height (height of the convex portion) of 2 mm, R of 0.1 mm at the apex of the convex portion, and R of 0.3 mm in the concave portion.

(Other Condition)

The two separating jigs (separating rolls) that configured the phase difference type separating device were caused to rotate at a speed of 360° per second in the same direction as the strands traveling direction, the separating portion in any one separating roll came into contact with the reinforcing fiber strands all the time, and the smooth surface on the opposite side to the separating portion in the other separating roll came into contact with the strands. In this manner, the process was performed. At this time, the winding angle of the reinforcing fiber strands around the separating roll having the separating portion was 120°.

[Comparative Example 1] <Separating Process Flow>

Similar to Example 1, but instead of the wheel type separating jig, the following common separating jig was used. The separated yarns (having an average thickness of 0.08 mm) of the reinforcing fiber strands were produced through a separating process, which was not intermittently performed. When the continuous operation started, the fiber strands were gradually biased and converged to the separating portion, and thus it was not possible to perform stable separating.

(Separating Jig)

The separating jig was a fixed separating roll that had the separating portion over the entire circumference of a cylinder thereof, and had a diameter of 30 mm. The separating roll was made of cemented carbide and had an effective width of 60 mm on the fiber path. The separating portion was present over the entire circumference of the separating roll, and had a concave-convex pitch of 1 mm as intervals, a concave-convex height of 2 mm, R of 0.1 mm at the apex of the convex portion, and R of 0.3 mm in the concave portion.

DESCRIPTION OF REFERENCE NUMERALS

1. separating portion having a concave-convex shape (separating jig)

2. wheel (disk)

3. roller
4. fiber path of reinforcing fiber strands (separated yarns)
5. chain for synchronous rotating

The invention claimed is:

1. A method for producing yarns separated from reinforcing fiber strands comprising:

a process of intermittently separating fibers of the reinforcing fiber strands, wherein the process of intermittently separating fibers of the reinforcing fiber strands is performed using a separating jig, and wherein the separating jig is provided with a separating portion having a concave-convex shape formed by convex portions having a substantially dorsal fin shape and concave portions between the plurality of convex portions and the following conditions (1) and (2) are satisfied, (1) a height of a convex portion is one or more times a whole thickness of the strands, and (2) curvature radius R of a distal end of the convex portion is 0.01 mm to 50 mm.

2. The method for producing yarns separated from the reinforcing fiber strands according to claim 1, wherein the separating jig has a plurality of the separating portions.

3. The method for producing yarns separated from the reinforcing fiber strands according to claim 1, wherein the reinforcing fiber strands are brought into contact with the separating portion of the separating jig a plurality of times.

4. The method for producing yarns separated from the reinforcing fiber strands according to claim 1, wherein the reinforcing fiber strands are carbon fiber strands.

5. The method for producing yarns separated from reinforcing fiber strands according to claim 1, wherein, when the reinforcing fiber strands are brought into contact with the separating jig, a whole width of the reinforcing fiber strands is 1 mm to 300 mm.

6. The method for producing yarns separated from the reinforcing fiber strands according to claim 1, wherein the reinforcing fiber strands are widened by a widening jig before the process of intermittently separating the reinforcing fiber strands.

7. The method for producing yarns separated from the reinforcing fiber strands according to claim 1, wherein the concave-convex shape of the separating portion of the separating jig is concavity and convexity of the separated strands disposed in a width direction.

* * * * *